United States Patent [19]

Massari

[11] Patent Number: 4,471,506

[45] Date of Patent: Sep. 18, 1984

[54] TOOTHBRUSH WITH MULTI-POSITIONABLE HEAD

[76] Inventor: Berardo Massari, Via Gramsci, 76 Rozzano (Milano), Italy

[21] Appl. No.: 379,579

[22] Filed: May 17, 1982

[30] Foreign Application Priority Data

Jul. 13, 1981 [IT] Italy ..... 22893 A/81
Apr. 5, 1982 [IT] Italy ..... 20572 A/82

[51] Int. Cl.[3] ..... A46B 9/04
[52] U.S. Cl. ..... 15/172; 15/144 R; 15/176
[58] Field of Search ..... 15/145, 146, 172, 176, 15/144 R; 403/84, 97, 101, 159

[56] References Cited

U.S. PATENT DOCUMENTS

| | | | |
|---|---|---|---|
| 1,651,251 | 11/1927 | Calkins | 15/172 |
| 2,226,814 | 12/1940 | Gress | 15/176 |
| 2,609,251 | 9/1952 | Haupt | 403/97 |
| 2,719,998 | 10/1955 | Hibbs | 15/172 |
| 4,020,521 | 5/1977 | Velasquez | 15/172 |
| 4,330,896 | 5/1982 | Booth | 15/176 |

FOREIGN PATENT DOCUMENTS

| | | | |
|---|---|---|---|
| 2044089 | 10/1980 | United Kingdom | 15/176 |

*Primary Examiner*—Harvey C. Hornsby
*Assistant Examiner*—Michael Kniek
*Attorney, Agent, or Firm*—Michael J. Striker

[57] ABSTRACT

A toothbrush whose cleaning head can be set at various angles in relation to the handle, especially at 90°, and is interchangeable.

6 Claims, 13 Drawing Figures

TOOTHBRUSH WITH MULTI-POSITIONABLE HEAD

Toothbrushes for cleaning teeth, with the bristle-carrying head, or cleaning head, aligned with the handle, are commonly known objects. Though it is universally recognised that the most efficient way to clean the teeth is to move the brush up and down them, present toothbrushes on the market do not facilitate this movement being orthogonal to the line of the handle.

The subject of this disclosure is a toothbrush the handle of which can be set at any desired angle in relation to the head and on its plane, or on a plane parallel to it. The various angles given to the handle remain fixed by means of adequate friction between the revolving parts, or by means of suitable locking systems.

The angles at which the handle can be fixed are, especially at 0°, at 45°, and 90° and at 180°. In one type of execution, the handle can be given a fixed angle—in relation to the head, on its plane or on a plane parallel to it—between the values of 20° and 90°, and in particular at 45°.

Variations in the angle of the handle are obtained by means of a revolving joint comprising two counterposed supports, one being the back of the head and the other a tang practically parallel to the back of the head of which it forms a continuation. The top end of the handle fits in between these two supports and is prevented from accidently leaving them by groove and tongue joints. The groove and tongue joints are formed by two aligned pins respectively fixed to the back and front of the handle top. These pins fit into seats made for them one in the back of the head and the other in the tang. The tang can be raised enabling the handle to be pulled off the head and therefore replacement of the latter.

The handle is fixed at the various angles by means of projections on the handle itself placed radially around the middle of the joint and fitting into radial depressions in the back of the head or on the inside of the tang, or else by means of projections on the head and corresponding depressions on the handle. The surface of the handle is roughened sufficiently to prevent the fingers from slipping due to the combined effect of water, dentifrice and soap. It is proposed to make this toothbrush in at least two sizes, respectively suitable for adults and for children.

The characteristics and the purposes of the disclosure will be made even clearer by the following examples of its execution illustrated by drawings.

Figure 1:
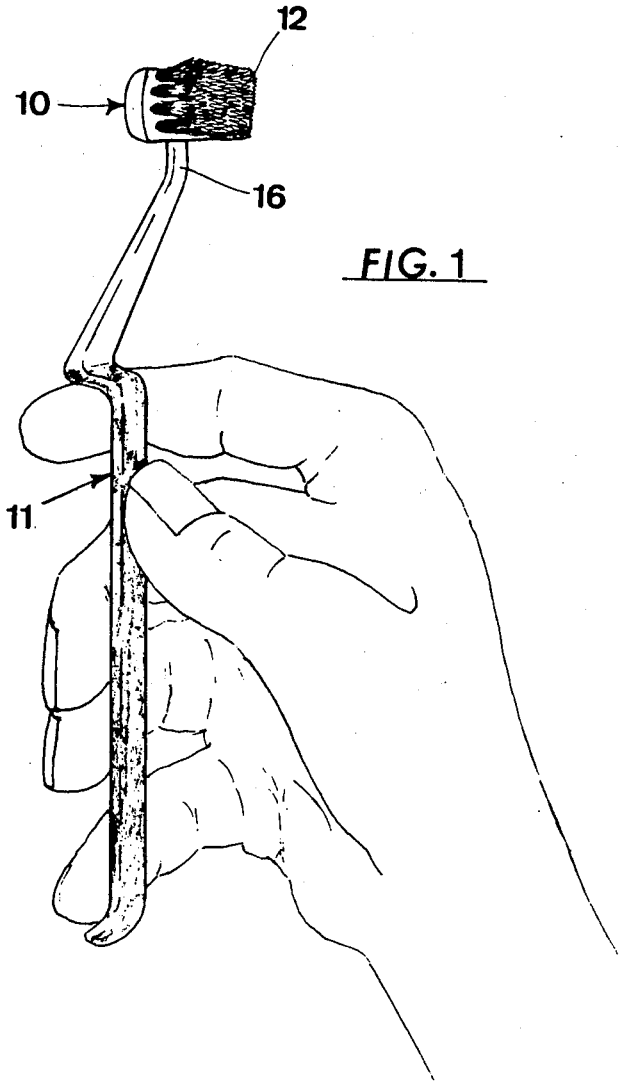

FIG. 1: Toothbrush with handle at 90°, held in the hand and seen in perspective.

Figure 2:
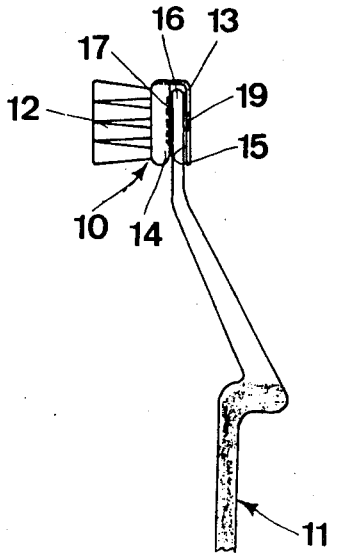

FIG. 2: Profile view of the toothbrush with handle at 90°.

Figure 3:
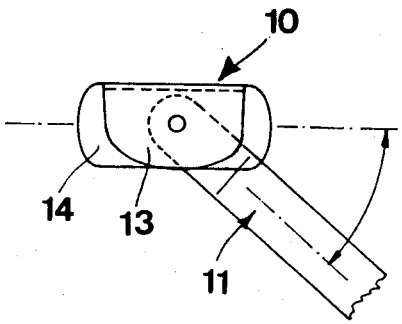

FIG. 3: Toothbrush with handle at 45°, back view.

Figure 4:
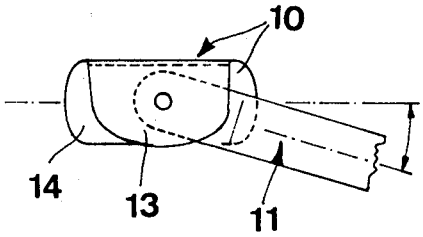

FIG. 4: Toothbrush with handle at 22.5°, back view.

Figure 5:
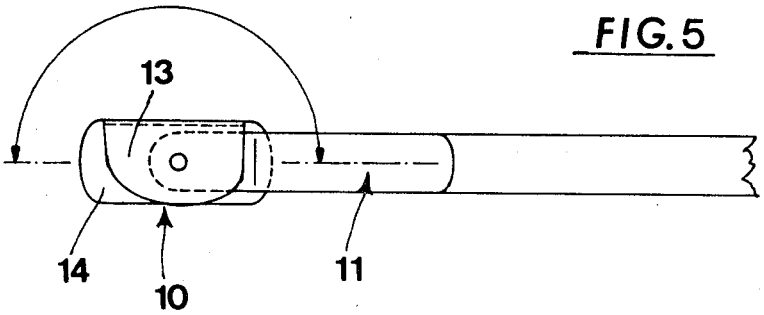

FIG. 5: Toothbrush with handle at 180°, back view.

Figure 6:
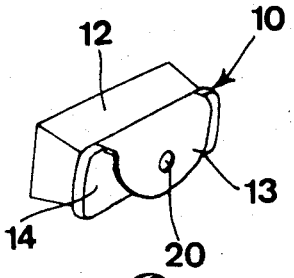

FIG. 6: Head seen from the back.

Figure 7:
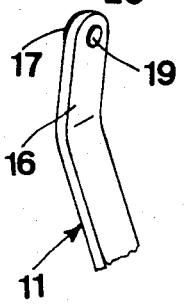

FIG. 7: Top of the handle seen from the back.

Figure 8:
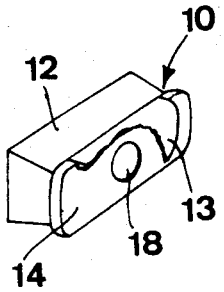

FIG. 8: Head seen from the back with part of the tang cut away.

Figure 9:
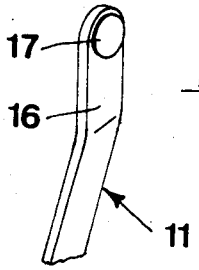

FIG. 9: Top of the handle seen from the front.

Figure 10:
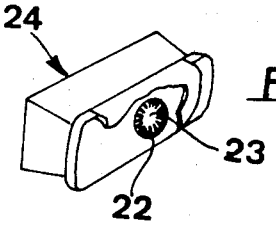

FIG. 10: Head with radially set locking teeth.

Figure 11:
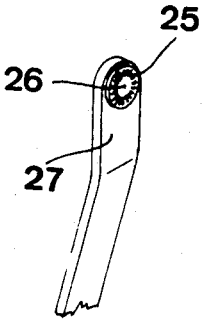

FIG. 11: Top of the handle seen from the front, with locking teeth.

Figure 12:
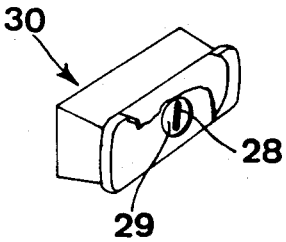

FIG. 12: Head with locking ribs.

Figure 13:
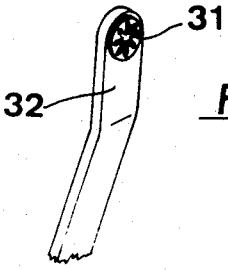

FIG. 13: Top of the handle with locking depressions.

Practically speaking the toothbrush consists of the cleaning head (10) with its bristles (12) and of the handle (11). The handle and the head are held together by means of the sprung tang (13) forming part of the head. The back (14) of the head (FIG. 2) and the inside surface (15) of the tang form a kind of reversed U-shaped fork which holds the top of the handle (16) firm. The top (see also FIGS. 6, 7, 8, 9) is fitted with a front pin (17), very wide and low, which sits in the cylindrical cavity (18) in the back of the head, and with a back pin (19), in line with the front one, which fits into hole (20) in the tang.

In this way a revolving joint is formed between the handle and the head; this joint not ony enables the handle to be turned in relation to the head, and vice versa, but also makes it possible to detach the handle from the head due to the spring effect of the tang (13). By slightly pressing the tang outwards and widening the reversed "U", the handle can be released.

As clearly shown in FIGS. 3, 4 and 5, the handle can be set at angles of 45°, 22.5°, 180° and any other in relation to the head. The handle can be set at the preferred inclination in a number of ways. The very wide pin (17) occupies an extended counterposed surface consisting of the cavity (18) creating, under the action of the elastic force of the tang (13), an amount of friction sufficient to prevent casual or unintentional rotation of the head in relation to the handle. FIGS. 10 and 11 illustrate another method. When the handle has been fitted in, the radial projections (22) in slot (23) of the head (24), lie in the intermediate grooves between the radial projections (25) on the pin (26) at the top (27) of the handle, while these latter projections simultaneously penetrate into the grooves between the projections (22).

The tang's yielding movement enables the preferred inclination to be given to the head. In the same way the tang's flexible resistance prevents the head from undesired rotation. FIGS. 12 and 13 illustrate a method of stabilizing the parts realized by the diametral rib (28) on the bottom of the slot (29) of the head (30), which rib can penetrate into one of the diametral niches (31) at the top (32) of the handle, the rib and the niche being at 45° one from the other.

The advantages of the invention can be clearly seen. The fact that the handle can be orientated means that the most effective angle can be obtained for cleaning the teeth, especially for the up and down movement, as well as being able to adapt the toothbrush to the user's personal preferences and needs. Interchangeability of the head allows it to be easily replaced and a single handle, with change of head, can be used by all the members of the family. By means of a combination of the various characteristics, such as variable inclination of the head, its short length, its rounded corners, the gradual thinning of the arm connecting the handle to the head as the latter is reached, the forward position given to the head in relation to the handle, easy access is ensured to the backs of even the innermost teeth.

As the applications of the invention have been described in the form of an example but in no way limited to this, it is understood that any equivalent application of the inventive concepts explained, and any product made and/or in operation in accordance with the characteristics of the disclosure will be covered by its field of protection.

I claim:

1. A toothbrush comprising a cleaning head having a back and formed with an elastic tang; a handle having an upper flattened extremity; and a swivel joint connecting said handle to said cleaning head so that the handle can be moved in relation to the plane of the head or to the plane parallel to the head by any angle from 0° to 180°, said swivel joint including two counterposed supports, one of said supports being formed by the back of the head and the other of said supports being formed by the elastic tang extending sufficiently parallel to the back of the head and fixed to the latter, the upper flattened extremity of the handle being placed between said supports, and two aligned pins extended perpendicular to said extremity and fixed, respectively to the front and back of said extremity and revolvably lodged within corresponding seats formed in the back of the head and of the tang.

2. A toothbrush as defined in claim 1, wherein the elasticity of the tang is such as to allow the head to be pulled off the handle so that the head can be changed for a new one.

3. A toothbrush as defined in claim 1, wherein the handle is formed with ribs which stabilize its position at various angles, said ribs projecting from the handle and extending radially outwardly from the middle of the joint, said tang having radial grooves cut therein, said ribs being placed opposite said radial grooves, each rib being adapted to enter or leave a respective groove due to the elasticity of the tang.

4. A toothbrush as defined in claim 1, wherein the tang of the head is formed with ribs projecting from the handle and extending radially outwardly from the middle of the joint, said handle having radial grooves cut therein, the ribs being placed opposite said radial grooves, each rib being adapted to enter or leave a respective groove due to the elasticity of the tang.

5. A toothbrush as defined in claim 1, wherein the handle is provided with a handgrip extended parallel to the plane of the back, and an arm connecting the handgrip to the head, said arm being inclined towards the head for greater suitability to the shape of the face, the handgrip having a length which is limited at a top and a bottom thereof by projections extending towards the back of the head so as to give anatomical support and guidance to the fingers of the hand when the toothbrush is used.

6. A toothbrush comprising a cleaning head including a back having a plane and an elastic tang extending substantially parallel to said back and connected to the latter; a handle having an axis and an upper flattened extremity; and a swivel joint connecting said handle to said cleaning head so that the handle can be moved in relation to the plane of said back by any angle from 0° to 180°, said swivel joint including two counterposed supports, one of said supports being formed by the back of the head and the other of said supports being formed by the elastic tang, the upper flattened extremity of the handle being placed between said supports, said flattened extremity having a front side and a back side, and two aligned pins extended perpendicular to said extremity and fixed, respectively to the front side and the back side of said extremity and revolvably lodged within corresponding seats formed in the back of the head and the tang, said head having a longitudinal axis and two opposite sides, said tang having two elongated sides and being connected to said back along one of said elongated sides so as to form with said back a narrow channel, said channel having a bottom which limits the movement of the handle in relation to said plane in two extreme positions each corresponding to alignment of the axis of the handle with the longitudinal axis of the head on each side of the head.

* * * * *